US011339629B2

(12) United States Patent
Inglis

(10) Patent No.: US 11,339,629 B2
(45) Date of Patent: May 24, 2022

(54) DOWNHOLE POWER GENERATING APPARATUS

(71) Applicant: Halliburton Energy Services, Inc., Houston, TX (US)

(72) Inventor: Peter Derek Walter Inglis, Dundee (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/002,569

(22) Filed: Aug. 25, 2020

(65) Prior Publication Data

US 2022/0065078 A1 Mar. 3, 2022

(51) Int. Cl.
*E21B 41/00* (2006.01)
*E21B 34/06* (2006.01)
*E21B 43/12* (2006.01)

(52) U.S. Cl.
CPC ..... *E21B 41/0085* (2013.01); *E21B 34/06* (2013.01); *E21B 43/127* (2013.01)

(58) Field of Classification Search
CPC ..... E21B 41/0085; E21B 34/10
See application file for complete search history.

(56) References Cited

U.S. PATENT DOCUMENTS 4,515,225 A 5/1985 Dailey
5,149,984 A 9/1992 Schultz et al.
5,839,508 A * 11/1998 Tubel ..... G01V 1/42 166/65.1
6,321,847 B1 11/2001 Brown
7,002,261 B2 2/2006 Cousins
7,834,777 B2 11/2010 Gold
8,179,278 B2 5/2012 Shakra et al.
9,546,539 B2 1/2017 Hudson et al.
2003/0116969 A1* 6/2003 Skinner ..... E21B 41/0085 290/1 R
2011/0148656 A1 6/2011 Hudson et al.
(Continued)

FOREIGN PATENT DOCUMENTS

WO 2011081684 A1 7/2011
WO 2017015004 1/2017

OTHER PUBLICATIONS

International Search Report and Written Opinion dated May 7, 2021; International PCT Application No. PCT/US2020/048501.
(Continued)

*Primary Examiner* — Brad Harcourt
(74) *Attorney, Agent, or Firm* — McGuireWoods LLP

(57) ABSTRACT

A downhole power generating apparatus comprising a low pressure chamber, a floating piston, a high pressure chamber, a first flow through path, a second flow through path, and a turbine. The low pressure chamber includes an inlet and an outlet for cycling tubing fluid. The floating piston separates the low pressure chamber into an upper and lower section. The floating piston is cyclically responsive to a cycle of tubing fluid and another cycle of tubing fluid. The first flow through path couples a fluid from the lower section of the low pressure chamber to the high pressure chamber in response to a cyclical response of the floating piston. The second flow through path couples the fluid from the high pressure chamber to the lower section in response to another cyclical response of the floating piston.

18 Claims, 4 Drawing Sheets

(56) References Cited

U.S. PATENT DOCUMENTS

| | | | | |
|---|---|---|---|---|
| 2016/0138358 | A1 | 5/2016 | Whitby et al. | |
| 2016/0265315 | A1* | 9/2016 | Frosell | H02K 7/1823 |
| 2018/0209231 | A1 | 7/2018 | Heijnen et al. | |
| 2020/0208498 | A1 | 7/2020 | Duggan et al. | |

OTHER PUBLICATIONS

Price, Timothy F. Development of a High-Pressure/High-Temperature Downhole Turbine Generator. Dexter Magnetic Technologies Inc, 2007.

* cited by examiner

DOWNHOLE POWER GENERATING APPARATUS

BACKGROUND

The development and production of hydrocarbon reservoirs are complex endeavors that require various types of tools. Often times these tools require a source of power. In some cases, the type of operation requires power delivered downhole over a power cable. However, in some cases the use of a power source sourced from the surface and delivered over a power cable is not practical. In these particular cases, devices requiring power, such as gauges or valves, rely upon battery and wireless activation. However, well completion processes can last months and possibly years. As such, the batteries can lose their charge with time and extended use. As such, a need exists for a downhole power generating apparatus.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
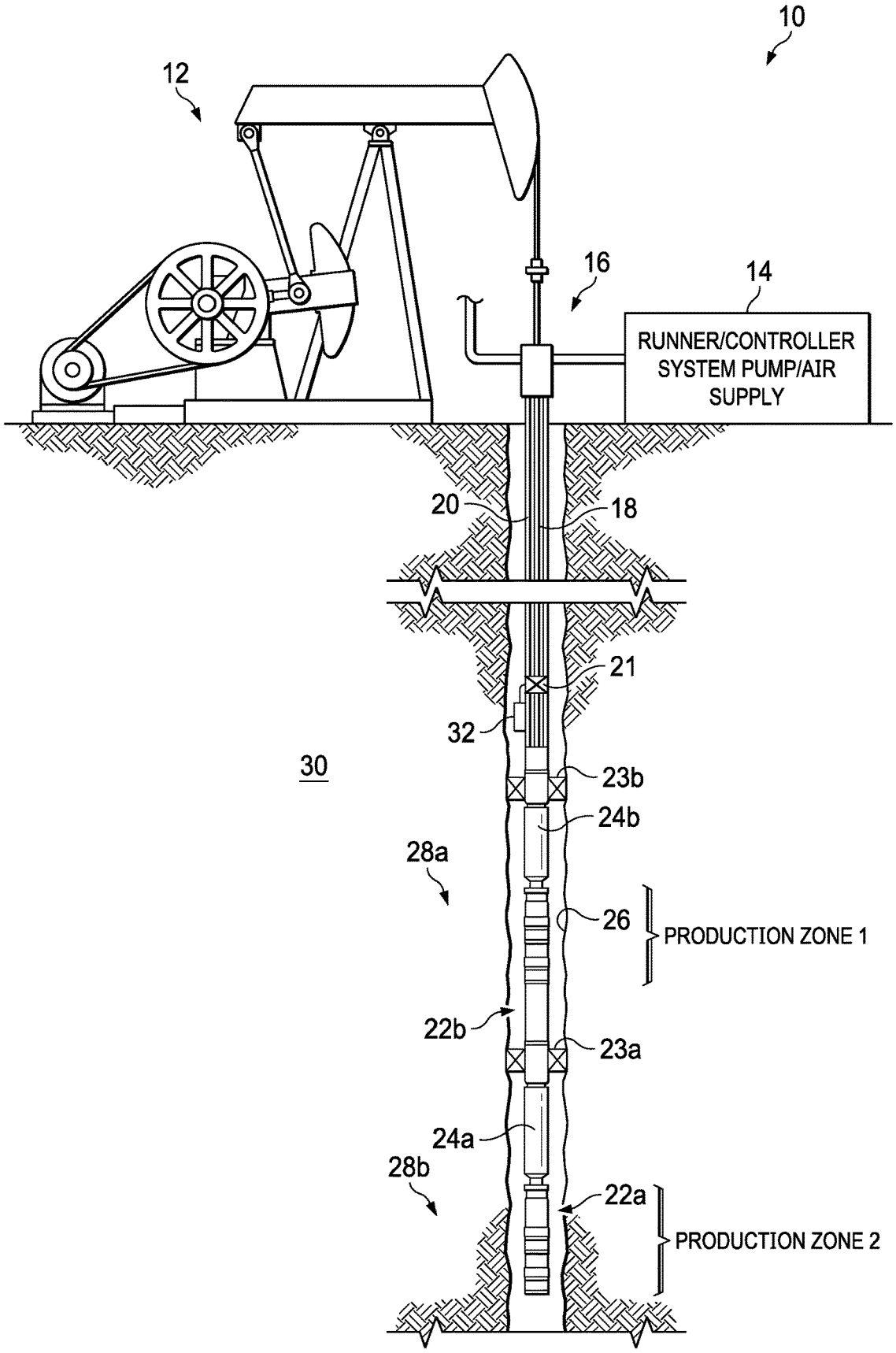
FIG. 1 is an illustration of a diagram of a well site operation for generating power using a downhole power generating device, in accordance with certain example embodiments.

While various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

As previously stated, a need exists for a downhole power generating apparatus. A particular challenge is how to generate power in a downhole environment and how to do so using available resources, such as pressurized fluid, and to do so without interruptions to a production zone or well completion processes. Regarding the latter requirement, a lot of completion processes require full use of a main bore of development and production tubing. As a scenario, if a barrier valve needs to be closed to isolate a production zone for a completion process upstream from the production zone, using the main bore to provide power may not be practical. Specifically, what is needed is a power generating apparatus that can be mated or coupled with certain completion tools, e.g. completion tubing, that uses pressurized fluid to generate power but do so without intruding into the bore of production tubing and/or completion tubing.

Presented herein is a downhole power generating apparatus that comprises a low pressure chamber, a floating piston, a high pressure chamber, a first flow through path, a second flow through path, and a turbine. The low pressure chambers includes an inlet and an outlet for cycling tubing fluid. The floating piston separates the low pressure chamber into an upper section and a lower section. The floating piston is cyclically responsive to a cycle of tubing fluid and another cycle of tubing fluid, such that the pressure in the upper and lower section of the low pressure chamber is normally equal. The first flow through path couples a fluid from the lower section to the high pressure chamber in response to a cyclical response of the floating piston. The second flow through path couples the fluid from the high pressure chamber to the lower section in response to another cyclical response of the floating piston. The turbine generates power in response to at least one selected from a group comprising the fluid coupled from the lower section to the high pressure chamber and the fluid coupled from the high pressure chamber into the lower section. Also presented herein is a downhole power generating system that includes the aforementioned downhole power generating apparatus and either hydrocarbon reservoir tubing or a valve having at least one rechargeable battery.

In some embodiment, the downhole power generating apparatus and system can include a filter for filtering the tubing fluid. Also, the downhole power generating apparatus and system can comprise at least one directional flow control valve disposed in the first flow through path and at least one other directional flow control valve disposed in the second flow through path. The directional flow control valves can be check valves. In alternative embodiments, one or more of the flow control valves may be replaced by flow restrictors. In addition, the turbine can be disposed in the first flow through path or the second flow through path. In another embodiment, the turbine can be disposed in the first flow through path and another turbine in the second flow through path. The fluid can be a silicone oil or inert gas or similar compressible fluids.

Also present herein is a method for generating power downhole. The method includes coupling a high pressure chamber and a low pressure chamber to hydrocarbon reservoir tubing, placing the hydrocarbon reservoir tubing downhole, pumping tubing fluid into an inlet of the low pressure chamber, using a floating piston to pump fluid from a lower section of the low pressure chamber through a flow through path and into the high pressure chamber, releasing the tubing fluid from an outlet of the low pressure chamber, pumping the fluid from the high pressure chamber into the section of the low pressure chamber using another flow through path, and generating power using a turbine in response to pumping fluid from at least one selected from a group comprising the lower section of the low pressure chamber into the high pressure chamber and the high pressure chamber in the section of the low pressure chamber.

In some embodiments, the method can include filtering the tubing fluid. Also, the method can include pumping the fluid into at least one directional flow control valve disposed in the flow through path and releasing the fluid through at least one other directional flow control valve disposed in the other flow through path. However, as previously stated, in an alternative embodiments, flow restrictors can be used in place of the directional flow control valve. In addition, the method can include placing the turbine in series with the at least one directional flow control valve or the at least one other directional check valve. In addition, the low section and the high pressure chamber include either silicone oil or an inert gas or other compressible fluid.

Referring now to FIG. 1, illustrated is a diagram of a well site operation for generating power using a downhole power generating apparatus, according to certain example embodiments, denoted generally as 10. The well site operation 10 comprises a pump jack 12, a controller 14, a polished rod, stuffing box and tee assembly 16, production tubing 18, completion tubing 20, a barrier valve 21, a series of coupled joints and hydraulic screens 22*a*, 22*b*, packers 23*a*, 23*b*, pump and injector systems 24*a*, 24*b*, and wellbore 26, production zones for accessing hydrocarbons in an earth formation 30, and a downhole power generating apparatus 32. Although the well site operation 10 depicts a land based well, the operation site 10 can be any type of well site where the production of a hydrocarbon reservoir occurs. Furthermore, although the operation site 10 is related to the development and production of a fracking operation, the operation site 10 can be any type of operation that requires the use of a downhole power generation apparatus 32 for well completion operations.

Completion tubing 20 can be liner hanger and casing or any type of equipment that functions to secure the series of coupled joints and hydraulic screens 22*a*, 22*b*, packers 23*a*, 23*b*, and pump and injector systems 24*a*, 24*b* to a running string of the controller 14. Production tubing 18 is also secured to the running string. In a well completion process, the barrier valve 21 may be opened and closed several times. Typically this is done to allow access to a reservoir at an appropriate time and protect the hydrocarbon reservoir from debris, such as cement, or to protect equipment from damage that can occur during a well construction process upstream from the equipment. It should be understood that in FIG. 1 although the well and equipment below the barrier valve 21 may be completed and ready for production, there can be at any time during the life of the well further development above the barrier valve 21. Trying to open and close the barrier valve 21 during this development may not be practical because it would require access to the bore of the production tubing 18 and the completion tubing 20, which, again, this may not be possible or practical during this stage. As mentioned before, the barrier valve 21 may need to be operated over several months or possibly years and during this phase the batteries used to power the valve 21 to allow it to open and close may need to be recharged. Alternatively, the barrier valve 21 may not even require batteries to operate but rather instead use the downhole power generating apparatus 32. It should be understood that the use of the downhole power generating apparatus 32 to provide power to the barrier valve 21 is only one example and the downhole power generating apparatus 32 can be used with any downhole device that requires power. It should be understood that although the downhole power generating apparatus 32 is illustrated as being couple to the completion tubing 20 it can be attached to anything, such as the wellbore 26, as long as it does not interfere with the internal diameter of the production tubing 18 and/or the completion tubing 20

Figure 2A:
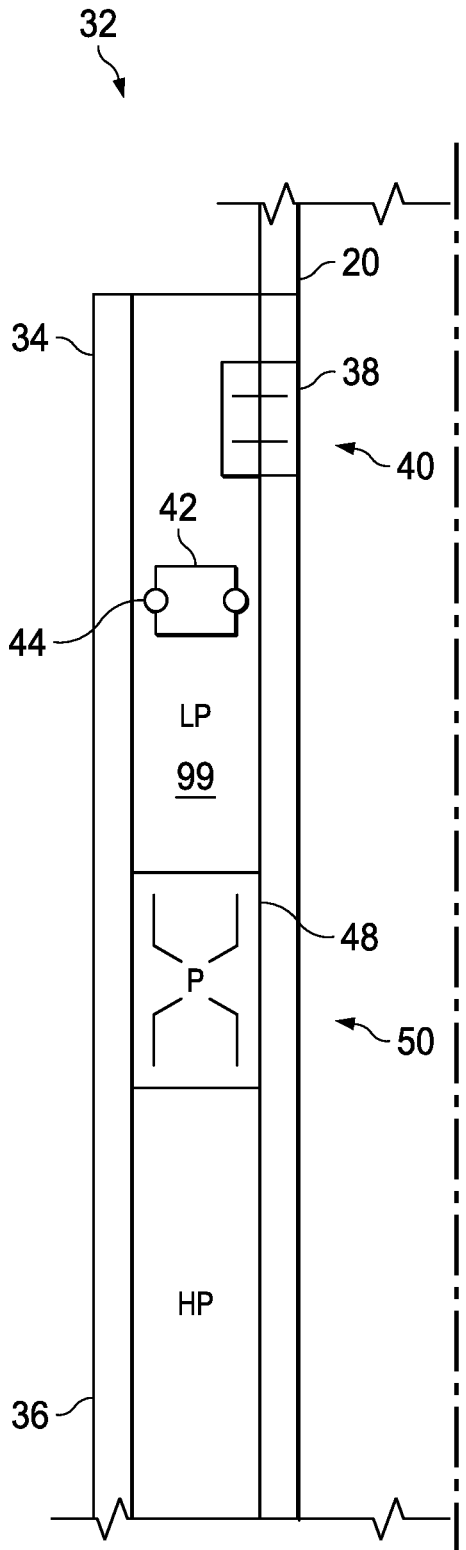
FIG. 2A is an illustration of the downhole power generating apparatus, in accordance with certain example embodiments.

Referring now to FIG. 2A, illustrated is the downhole power generating apparatus 32, according to example embodiments. The power generating apparatus 32 comprises a low pressure chamber 34, a high pressure chamber 36, a lantern filter 38, inlets/outlets 40 or simply ports, a floating piston 42, seals 44, a bulkhead 48, and a power generator 50. The floating piston 42 separates the low pressure chamber 34 into an upper section and a lower section 99 defined by the position of the floating piston 42. The seals can be O-ring type seals made of elastomer that can effectively hydraulically separate the upper section from the lower section 99 and allows for the displacement action of the floating piston 42. In other words, the seals 44 allow the floating piston 42 to be positioned within the low pressure chamber 34 in response to a pressure applied to the floating piston 42. The lantern filter 38 and the seals 44 function to keep debris out of the lower section 99 of the low pressure chamber 34 and the power generator 50. The lantern filter 38 is specifically used to keep large debris from the upper section of the low pressure chamber 34. The seals 44 keep the finer debris from the power generator 50, along with pressurized fluid conducted through the completion tubing 20. The lower section 99 of the low pressure chamber 34 and the high pressure chamber 36 are filled with a compressible fluid, such as silicone oil, or an inert gas, such as nitrogen or other compressible fluid.

Figure 2B:
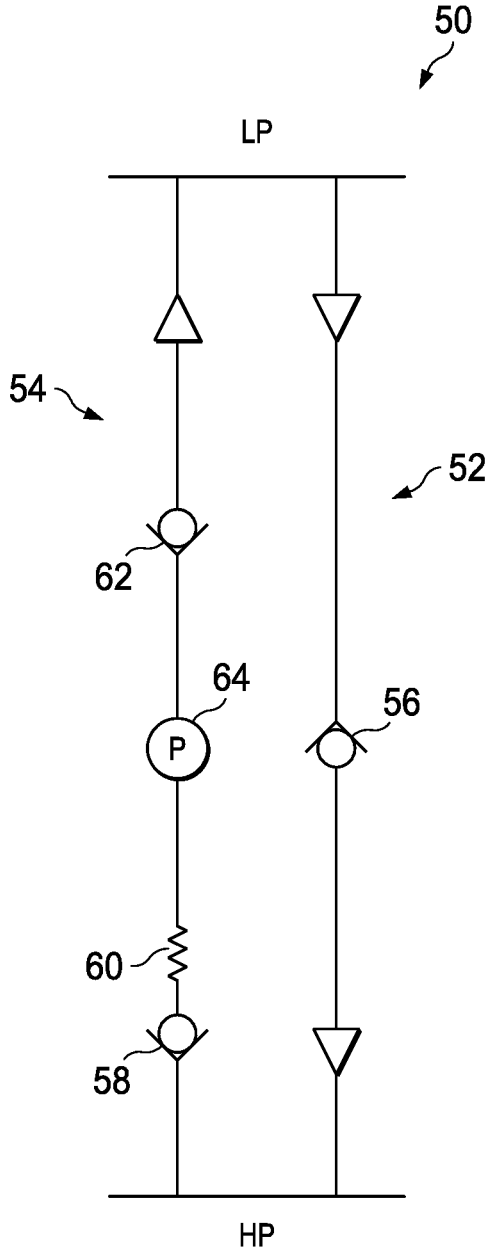
FIG. 2B is an illustration of a power generator of the downhole power generating apparatus, in accordance with certain example embodiments.

The power generator 50 is inside of the bulkhead 48. The bulkhead 48 is, in essence, a partition that separates the lower section 99 of the low pressure chamber 34 from the high pressure chamber 36. The power generator 50 fluidly couples the lower section 99 of the low pressure chamber 34 with the high pressure chamber 36. The power generator 50, see FIG. 2B, comprises a Low Pressure (LP) to High Pressure (HP) flow through path 52 and a High Pressure (HP) to Low Pressure (LP) flow through path 54. Flow through path 52 comprises at least one directional flow control valve 56, such as a check valve. Flow through path 54 comprises at least one directional flow control valve 58, 62, again such as a check valve, and a turbine 64. In some embodiments, the flow through path 54 may comprise in addition a flow restrictor 60 as well as or instead of check valve 58 to reduce the flow rate of the fluid into the turbine 64. Additionally, in some embodiments there may be a turbine for each flow through path 52, 54 and even multiple turbines for each flow through path 52, 54, or multiple flow paths that are duplicates of flow through path 52, 54.

In practice, when the pressure of the tubing bore is increased, well fluid, also referred to herein as tubing fluid, is pumped down the bore of the completion tubing 20, through the filter 38, the inlets 40. When the tubing pressure is released, the tubing fluid may flow from the upper region of the low pressure chamber 34 and released out back to the tubing bore via the outlets 40. The inlets and the outlets can obviously be the same apertures. This cycle can be repeated a number of times. As the tubing pressure is increased, tubing fluid enters the upper section of the low pressure chamber 34 the floating piston 42 is displaced compressing the silicone oil in the lower section 99 of the low pressure chamber 34 through the flow through path 52 and into the high pressure chamber 36 increasing the pressure in the high pressure chamber to be the same as the low pressure chamber and the tubing bore. As the tubing pressure is reduced, the tubing fluid in the upper section of the low pressure chamber 34 flows back into the tubing bore via the ports 40 causing the floating piston 42 to be displaced again by the silicone oil decompressing as a result of it being forced from the high pressure chamber 36, through the flow through path 54, and into the lower section 99 of the low pressure chamber 34. In response to the fluid movement through flow path 54, the turbine 64 generates power that can be used to provide power to barrier valve 21 or to charge batteries.

The directional flow control valves can be miniature hydraulic components, which allows fluid to traverse the valve in one of two directions. A flow restrictor 60 provides a restriction to the fluid flow thus slows the fluid flow rate down as the fluid flows from the HP to LP chambers. The turbine 64 is a traditional small sized turbine. The turbine 64 is a rotary mechanical device that extracts energy from the fluid flowing through the flow through paths 52, 54 and converts it into electrical power. Traditionally, these types of devices are electric generators and uses fluid flow to create a magnetic field which is then converted to electric current by a stator.

Figure 2C:
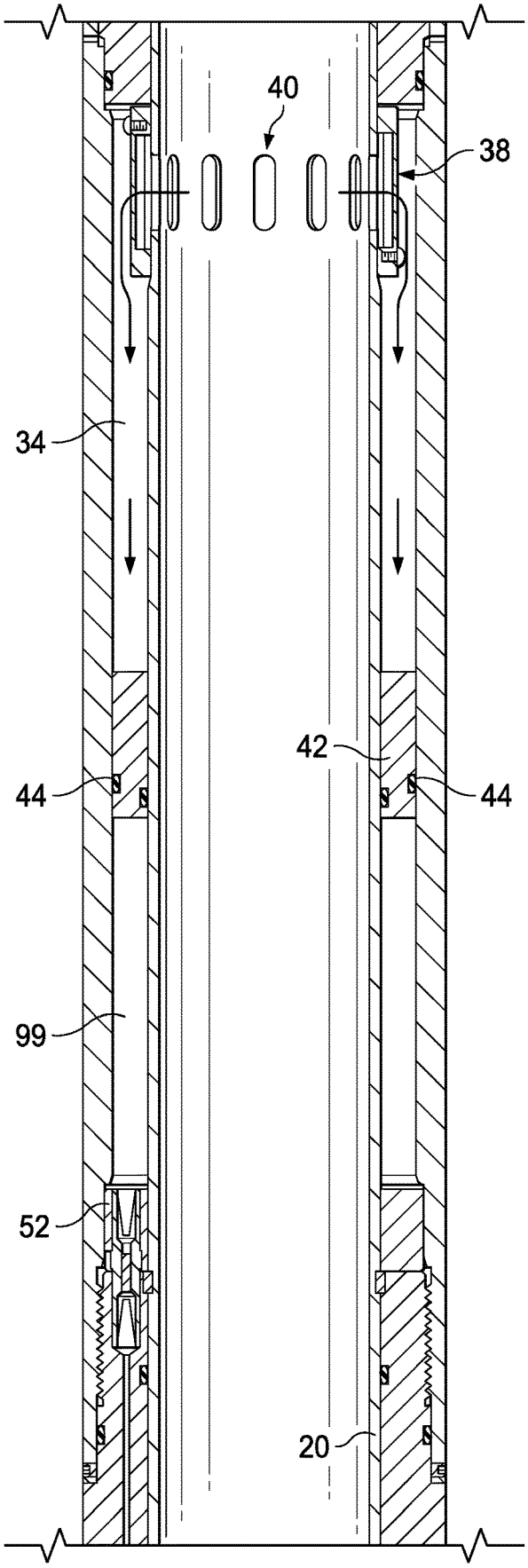
FIG. 2C is an illustration of a cross section view of a low pressure chamber of the downhole power generating apparatus and completion tubing, in accordance with example embodiments.
Figure 2D:
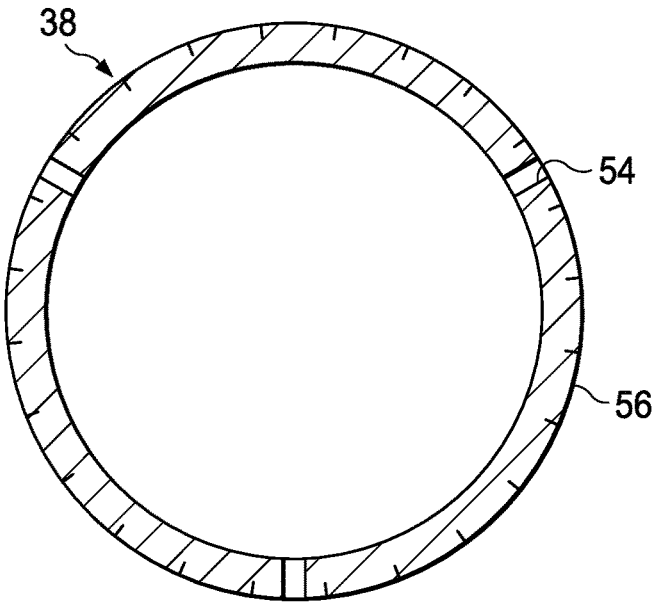
FIG. 2D is a cross sectional view of a lantern filter of the downhole power generating apparatus, in accordance with certain example embodiments.
Figure 2E:
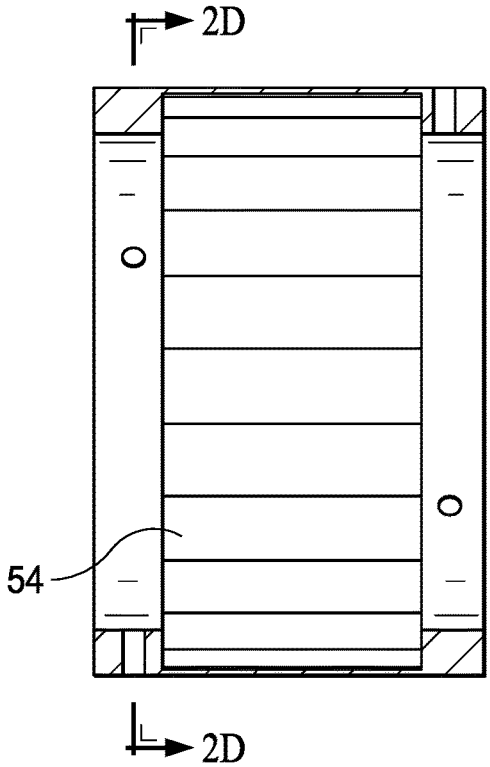
FIG. 2E is another cross sectional view of the lantern filter of the downhole power generating apparatus, in accordance with certain example embodiments.

Referring now to FIG. 2C, illustrated is a cross sectional view of the low pressure chamber 34, 99 and completion tubing 20, according to certain example embodiments. Tubing fluid pumped downhole can traverse the inlets/outlets 40 of the completion tubing 20 and into the low pressure chamber 34. The low pressure chamber 34 can be coupled to the completion tubing 20. The pressurized fluid displaces the floating piston 42 compressing the silicone oil in the lower section 99 of the low pressure chamber 34. The lower section 99 is defined as the section of the annulus below the floating piston 34. The compressive force causes the silicone oil to flow through the flow through path 52 and directional flow control valve 56 (not illustrated). Once the tubing pressure is reduced, pressurized fluid is released from the annulus and back through the inlets/outlets 40, the silicone oil is decompressed and silicone oil from the high pressure chamber 36 (not illustrated) is forced through the flow through path 54 (not illustrated), the control valves 58, 62 (not illustrated), the turbine 64 (not illustrated), and back into the lower section 99 of the low pressure chamber 34. The generator generates power in response to this flow of fluid through flow path 54, which includes flow through turbine 64, which can be used by the barrier valve to open or close the valve or to charge the batteries of the valve (or other downhole tool) for later use. FIGS. 2D and 2E are cross sectional views of the lantern filter 38. The lantern filter 38 comprises a plurality slots 54 for fluid to traverse and fingers 56 connecting the slots 54. In some embodiments, the fingers can be cut to make something similar to a cantilever, which allows the slot to flex. The flexing action of the slot 54 allows the aperture size of the slot to increase in the event debris builds up. However, it should be understood that the low pressure chamber 34 may not include the lantern filter 38 and may simple include only an inlet/outlet or inlets/outlets for receiving the tubing fluid. Although the filter has been described as a lantern filter, it should be understood that any type of filter used in downhole well environments to filter debris is applicable. The lantern filter 38 is an example of one possible filter type that can be used to filter debris.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a downhole power generating apparatus comprising: a low pressure chamber having an inlet and an outlet for cycling tubing fluid; a floating piston separating the low pressure chamber into an upper section and a lower section, the floating piston cyclically responsive to a cycle of tubing fluid and another cycle of tubing fluid; a high pressure chamber; a first flow through path fluidly for coupling a fluid from the lower section to the high pressure chamber in response to a cyclical response of the floating piston; a second flow through path fluidly for coupling the fluid from the high pressure chamber to the lower section in response to another cyclical response of the floating piston; and a turbine to generate power in response to at least one selected from a group comprising the fluid coupled from the lower section to the high pressure chamber and the fluid coupled from the high pressure chamber into the lower section;

Clause 2, the downhole power generating apparatus of clause 1, further comprising a filter for filtering the tubing fluid;

Clause 3, the downhole power generating apparatus of clause 1, further comprising at least one directional flow control valve disposed in the first flow through path and at least one other directional flow control valve disposed in the second flow through path;

Clause 4, the downhole power generating apparatus of clause 3, wherein the at least one directional flow control valve and the at least one other directional flow control valve are check valves;

Clause 5, the downhole power generating apparatus of clause 1, wherein the turbine is disposed in the first flow through path or the second flow through path;

Clause 6, the downhole power generating apparatus of clause 1, further comprises the turbine is disposed in the first flow through path and another turbine is disposed in a second turbine disposed in the first flow through path;

Clause 7, the downhole power generating apparatus of clause 1, wherein the fluid comprise at least one selected from a group comprising silicone oil, inert gas, and compressible fluid;

Clause 8, a downhole power generating system comprising: hydrocarbon reservoir tubing; a low pressure chamber having an inlet and an outlet for cycling tubing fluid; a floating piston separating the low pressure chamber into an upper section and a lower section, the floating piston cyclically responsive to a cycle of tubing fluid and another cycle of tubing fluid; a high pressure chamber; a first flow through path fluidly for coupling a fluid from the lower section to the high pressure chamber in response to a cyclical response of the floating piston; a second flow through path fluidly for coupling the fluid from the high pressure chamber to the lower section in response to another cyclical response of the floating piston; and a turbine to generate power in response to the fluid coupled from the lower section to the high pressure chamber and the fluid coupled from the high pressure chamber into the lower section;

Clause 9, the downhole power generating system of clause 8, further comprising a filter for filtering the tubing fluid;

Clause 10, the downhole power generating system of clause 8, further comprising at least one directional flow control valve disposed in the first flow through path and at least one other directional flow control valve disposed in the second flow through path;

Clause 11, the downhole power generating system of clause 10, wherein the at least one directional flow control valve and the at least one other directional flow control valve are check valves;

Clause 12, the downhole power generating system of clause 8, wherein the turbine is disposed in the first flow through path or the second flow through path;

Clause 13, the downhole power generating system of clause 8, further comprises the turbine is disposed in the first flow through path and another turbine is disposed in a second turbine disposed in the first flow through path;

Clause 14, the downhole power generating system of clause 8, wherein the fluid comprise at least one selected from a group comprising silicone oil, inert gas, and compressible fluid;

Clause 15, a method for generating power downhole, the method comprising: coupling a high pressure chamber and a low pressure chamber to hydrocarbon reservoir tubing; placing the hydrocarbon reservoir tubing downhole; pumping tubing fluid into an inlet of the low pressure chamber; using a floating piston to pump fluid from a lower section of the low pressure chamber through a flow through path and into the high pressure chamber; releasing the tubing fluid from an outlet of the low pressure chamber; pumping the fluid from the high pressure chamber into the section of the low pressure chamber using another flow through path; and generating power using a turbine in response to pumping fluid from at least one selected from a group comprising the lower section of the low pressure chamber into the high pressure chamber and the high pressure chamber in the section of the low pressure chamber;

Clause 16, the method of clause 15, further comprising filtering the tubing fluid;

Clause 17, the method of clause 15, further comprises pumping the fluid into at least one directional flow control valve disposed in the flow through path and releasing the fluid through at least one other directional flow control valve disposed in the other flow through path;

Clause 18, the method of clause 17, further comprises placing the turbine in series with the at least one directional flow control valve or the at least one other directional check valve;

Clause 19, the method of clause 17, further comprises placing the turbine in series with the at least one directional flow control valve and a second turbine in series with the at least one other directional check valve; and Clause 20, the method of clause 15, wherein the lower section and the high pressure chamber comprises at least one selected from a group comprising silicone oil, inert gas, and compressible fluid.

What is claimed is:

1. A downhole power generating apparatus comprising:

a low pressure chamber having an inlet and an outlet for cycling tubing fluid;

a floating piston separating the low pressure chamber into an upper section and a lower section, the floating piston cyclically responsive to a cycle of tubing fluid and a another cycle of tubing fluid;

a high pressure chamber;

a first flow through path fluidly for coupling a fluid from the lower section of the low pressure chamber to the high pressure chamber in response to a cyclical response of the floating piston;

a second flow through path fluidly for coupling the fluid from the high pressure chamber to the lower section of the low pressure chamber in response to another cyclical response of the floating piston; and a turbine to generate power in response to at least one selected from a group comprising the fluid coupled from the lower section of the low pressure chamber to the high pressure chamber and the fluid coupled from the high pressure chamber into the lower section of the low pressure chamber, wherein the turbine is disposed in the first flow through path or the second flow through path.

2. The downhole power generating apparatus of claim 1, further comprising a filter for filtering the tubing fluid.

3. The downhole power generating apparatus of claim 1, further comprising at least one directional flow control valve disposed in the first flow through path and at least one other directional flow control valve disposed in the second flow through path.

4. The downhole power generating apparatus of claim 3, wherein the at least one directional flow control valve and the at least one other directional flow control valve are at least one selected from a group comprising check valves and flow restrictors.

5. The downhole power generating apparatus of claim 1, further comprises the turbine is disposed in the first flow through path and another turbine is disposed in a second turbine disposed in the first flow through path.

6. The downhole power generating apparatus of claim 1, wherein the fluid comprise at least one selected from a group comprising silicone oil, inert gas, and compressible fluid.

7. A downhole power generating system comprising:

hydrocarbon reservoir tubing;

a low pressure chamber having an inlet and an outlet for cycling tubing fluid;

a floating piston separating the low pressure chamber into an upper section and a lower section, the floating piston cyclically responsive to a cycle of tubing fluid and a another cycle of tubing fluid;

a high pressure chamber;

a first flow through path fluidly for coupling a fluid from the lower section of the low pressure chamber to the high pressure chamber in response to a cyclical response of the floating piston;

a second flow through path fluidly for coupling the fluid from the high pressure chamber to the lower section of the low pressure chamber in response to another cyclical response of the floating piston; and a turbine to generate power in response to at least one selected from a group comprising the fluid coupled from the lower section of the low pressure chamber to the high pressure chamber and the fluid coupled from the high pressure chamber into the lower section of the low pressure chamber, wherein the turbine is disposed in the first flow through path or the second flow through path.

8. The downhole power generating system of claim 7, further comprising a filter for filtering the tubing fluid.

9. The downhole power generating system of claim 7, further comprising at least one directional flow control valve disposed in the first flow through path and at least one other directional flow control valve disposed in the second flow through path.

10. The downhole power generating system of claim 9, wherein the at least one directional flow control valve and the at least one other directional flow control valve are at least one selected from a group comprising check valves and flow restrictors.

11. The downhole power generating system of claim 7, further comprises the turbine is disposed in the first flow through path and another turbine is disposed in a second turbine disposed in the first flow through path.

12. The downhole power generating system of claim 7, wherein the fluid comprise at least one selected from a group comprising silicone oil, inert gas, and compressible fluid.

13. A method for generating power downhole, the method comprising:

coupling a high pressure chamber and a low pressure chamber to hydrocarbon reservoir tubing;

placing the hydrocarbon reservoir tubing downhole;

pumping tubing fluid into an inlet of the low pressure chamber;

using a floating piston to pump fluid from a lower section of the low pressure chamber through a flow through path and into the high pressure chamber;

releasing the tubing fluid from an outlet of the low pressure chamber;

pumping the fluid from the high pressure chamber into the lower section of the low pressure chamber using another flow through path; and generating power using a turbine that is disposed in the flow through path or the other flow through path in response to pumping fluid from at least one selected from a group comprising the lower section of the low pressure chamber into the high pressure chamber and the high pressure chamber into the lower section of the low pressure chamber.

14. The method of claim 13, further comprising filtering the tubing fluid.

15. The method of claim 13, further comprises pumping the fluid into at least one directional flow control valve disposed in the flow through path and releasing the fluid through at least one other directional flow control valve disposed in the other flow through path.

16. The method of claim 15, further comprises placing the turbine in series with the at least one directional flow control valve, the at least one other directional check valve, or a flow restrictor.

17. The method of claim 15, further comprises placing the turbine in series with the at least one directional flow control valve and a second turbine in series with the at least one other directional check valve.

18. The method of claim 13, wherein the lower section and the high pressure chamber comprises at least one selected from a group comprising silicone oil, inert gas, and compressible fluid.

* * * * *